US009586746B2

(12) United States Patent
Persells

(10) Patent No.: US 9,586,746 B2
(45) Date of Patent: Mar. 7, 2017

(54) MICROWAVE PACKAGE FOR SINGLE-STEP COOKING OF MULTI-COMPONENT FOODSTUFFS

(71) Applicant: Schwan's Global Supply Chain, Inc., Marshall, MN (US)

(72) Inventor: Jim Persells, St. Louis, MO (US)

(73) Assignee: SFC Global Supply Chain, Inc., Marshall, MN (US)

( * ) Notice: Subject to any disclaimer, the term of this patent is extended or adjusted under 35 U.S.C. 154(b) by 342 days.

(21) Appl. No.: 13/781,146

(22) Filed: Feb. 28, 2013

(65) Prior Publication Data

US 2013/0327763 A1 Dec. 12, 2013

Related U.S. Application Data

(60) Provisional application No. 61/658,160, filed on Jun. 11, 2012.

(51) Int. Cl.

| | |
|---|---|
| ***H05B 6/80*** | (2006.01) |
| ***B65D 81/34*** | (2006.01) |
| ***B65D 43/16*** | (2006.01) |

(52) U.S. Cl.

CPC ..... *B65D 81/3453* (2013.01); *B65D 43/162* (2013.01); *B65D 2205/02* (2013.01); *B65D 2581/344* (2013.01); *B65D 2581/3408* (2013.01); *B65D 2581/3416* (2013.01); *B65D 2581/3456* (2013.01); *B65D 2581/3498* (2013.01)

(58) Field of Classification Search

CPC ..... B65D 81/3453; B65D 43/162; B65D 2205/02; B65D 2581/3408; B65D 2581/344; B65D 2581/3456; B65D 2581/3498; B65D 2581/3416

USPC ..... 219/725–730, 732, 735, 753, 749; 426/107, 241, 243, 93, 113, 204, 292, 296

See application file for complete search history.

(56) References Cited

U.S. PATENT DOCUMENTS

| | | | | |
|---|---|---|---|---|
| 4,081,646 A * | 3/1978 | Goltsos | ..... | A47G 23/06 219/729 |
| 4,317,017 A | 2/1982 | Bowen | | |
| 4,705,927 A | 11/1987 | Levendusky et al. | | |
| 4,859,822 A | 8/1989 | Ragusa et al. | | |
| 4,935,592 A * | 6/1990 | Oppenheimer | .... | B65D 81/3453 219/730 |

(Continued)

FOREIGN PATENT DOCUMENTS

| | | |
|---|---|---|
| JP | 2008-271859 | 11/2008 |
| JP | 2010-126181 | 6/2010 |

(Continued)

OTHER PUBLICATIONS

International Search Report and Written Opinion for PCT/US2013/044660 mailed Nov. 12, 2013.

(Continued)

*Primary Examiner* — Quang Van

(74) *Attorney, Agent, or Firm* — Merchant & Gould P.C.

(57) ABSTRACT

A microwaveable container for transporting, freezing, storing, and cooking a multi-component foodstuff includes a tray having a base portion and a lid portion and employs a susceptor in combination with steam and venting to cook the multi-component foodstuff in a single microwave cooking step.

27 Claims, 11 Drawing Sheets

(56) References Cited

U.S. PATENT DOCUMENTS

| | | | | |
|---|---|---|---|---|
| 4,990,735 | A | 2/1991 | Lorenson et al. | |
| 5,026,958 | A * | 6/1991 | Palacios | A47J 36/022 219/732 |
| 5,041,295 | A | 8/1991 | Perry et al. | |
| 5,064,981 | A | 11/1991 | Bolton | |
| 5,416,305 | A | 5/1995 | Tambellini | |
| 5,484,984 | A | 1/1996 | Gics | |
| 5,543,606 | A | 8/1996 | Gics | |
| 5,900,264 | A | 5/1999 | Gics | |
| 6,303,913 | B1 | 10/2001 | Bono et al. | |
| 6,359,272 | B1 | 3/2002 | Sadek et al. | |
| 6,818,873 | B2 | 11/2004 | Savage et al. | |
| 7,141,771 | B2 | 11/2006 | Hopkins, Sr. | |
| 7,319,213 | B2 | 1/2008 | Tsontzidis et al. | |
| 7,525,075 | B1 | 4/2009 | Watkins et al. | |
| 7,683,298 | B2 | 3/2010 | Ly | |
| 2001/0024413 | A1 | 9/2001 | Nishiwaki et al. | |
| 2003/0071036 | A1* | 4/2003 | Savage et al. | 219/730 |
| 2005/0109772 | A1* | 5/2005 | Thorpe et al. | 219/732 |
| 2005/0173425 | A1* | 8/2005 | Wnek | B32B 7/02 219/730 |
| 2008/0175959 | A1* | 7/2008 | Hill | A23L 1/0005 426/90 |
| 2010/0059512 | A1 | 3/2010 | Keefe | |
| 2010/0065556 | A1 | 3/2010 | Cole | |
| 2010/0264135 | A1 | 10/2010 | Cole | |
| 2010/0270294 | A1 | 10/2010 | Lafferty | |
| 2011/0024413 | A1 | 2/2011 | Cole | |

FOREIGN PATENT DOCUMENTS

| | | |
|---|---|---|
| WO | WO 2006/068864 | 6/2006 |
| WO | WO 2010/147667 | 12/2010 |

OTHER PUBLICATIONS

Black Culinary Series Classic Microwave Hinged Clamshell Container, Retrieved Apr. 2012 from http://www.foodservicedirect.com/product.cfm/p/1947941/Black-Culinary-Series-Classic . . . .

* cited by examiner

MICROWAVE PACKAGE FOR SINGLE-STEP COOKING OF MULTI-COMPONENT FOODSTUFFS

This application claims priority to U.S. application Ser. No. 61/658,160 filed Jun. 11, 2012, which is hereby incorporated by reference in its entirety.

BACKGROUND

Microwaves allow for fast heating and cooking of various types of foodstuffs, but the effects of microwave cooking can make the final texture of certain foods unsatisfactory. For example, microwave cooking of a multi-component foodstuff, such as a sandwich type foodstuff, often involves multiple steps in which internal components of the sandwich such as meats, eggs, cheeses, vegetables, condiments, etc. are cooked separate from the external bread component of the sandwich and then combined with the external bread component for a period of combined cooking. These multiple cooking steps often provide a sandwich in which the bread component is hard, tough, and/or dry and internal sandwich components that are not evenly cooked and which may contain cold spots. In addition, the multiple cooking steps are often confusing to consumers, increase cooking time, and ultimately result in a less-than-satisfactory final cooked foodstuff. Therefore, it would be desirable to provide a microwaveable multi-component foodstuff, such as a sandwich type foodstuff, that consistently provides a quality hot food product that satisfies consumer expectations and perceptions of such a food product without multiple cooking steps.

SUMMARY

A microwaveable container for transporting, freezing, storing, and cooking a multi-component foodstuff is disclosed. The container provides for single-step microwave cooking of a multi-component foodstuff and provides a hot multi-component foodstuff comparable to those prepared by a traditional oven. In general, the container is a unitary tray having a base portion and a lid portion. The container employs a susceptor in combination with steam and venting to evenly and thoroughly cook the multi-component foodstuff in a single microwave cooking step.

BRIEF DESCRIPTION

An exemplary package for single-step microwave cooking of a multi-component foodstuff is depicted in the figures. Configurations, materials utilized, etc., are described below. The dimensions depicted are merely exemplary and may be modified accordingly as required or desired for a particular application. Other embodiments, configurations, dimensions, etc., are also contemplated.

DETAILED DESCRIPTION

Figure 1:
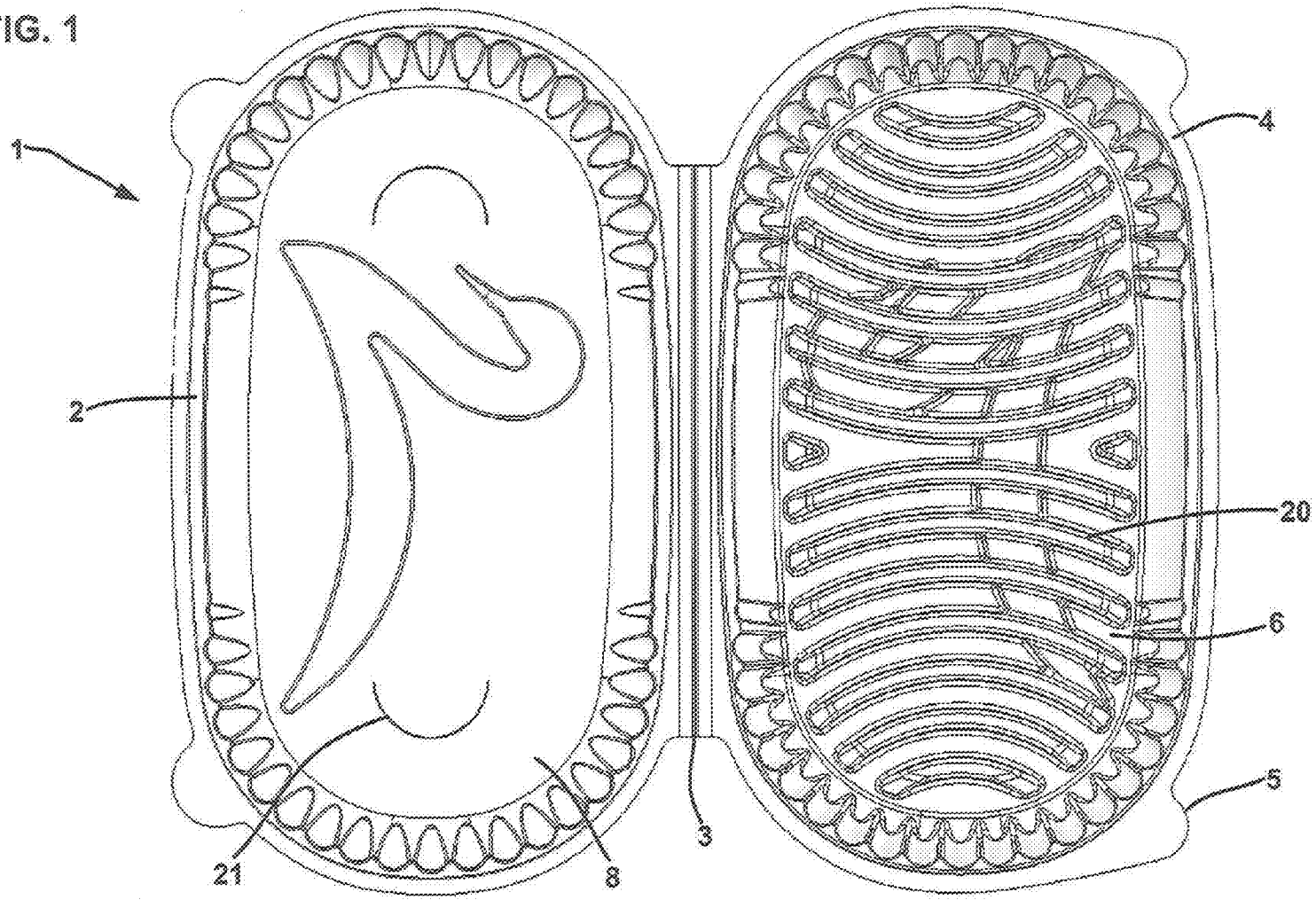
FIG. 1 depicts a top view of a container of the disclosure in an open position.

A microwaveable container for transporting, freezing, storing, and cooking a multi-component foodstuff is disclosed. The container provides for single-step microwave cooking of a multi-component foodstuff and provides a hot multi-component foodstuff comparable to those prepared by a traditional oven. The container employs a susceptor and steam to evenly and thoroughly cook the multi-component foodstuff in a single microwave cooking step.

"Multi-component foodstuffs," as used herein, includes both moisture-sensitive and moisture-insensitive food components. In this application, the term "moisture-sensitive" refers to food components that become soggy if subjected to too much moisture during a microwave cooking process that includes steam. As discussed in more detail below, steam in desired quantities provides a consistent cooking temperature and, in combination with the susceptor, evenly and thoroughly cooks and browns the moisture-sensitive food component in a single microwave cooking step providing a cooked food component that is not dry, tough, and/or hard. Examples of moisture-sensitive food components include breads, buns, muffins, pancakes, tortillas, and the like.

"Moisture-insensitive" refers to food components that benefit from more contact with steam generated during the microwave cooking process. The steam provides a consistent cooking temperature providing moisture-insensitive food components that are evenly and thoroughly cooked in a single microwave cooking step without cooking the moisture-insensitive components separate from the moisture-sensitive components of the multi-component foodstuff. Examples of moisture-insensitive food components include meats, eggs, cheeses, vegetables, condiments, soy-based proteins, and the like.

One example of a multi-component foodstuff is a sandwich type foodstuff. As used herein, a sandwich type foodstuff generally comprises a top and bottom external bread component and one or more internal components, such as meats, eggs, omelets, cheeses, vegetables, fruits, condiments, vegetable-based meat substitutes, and the like. Alternatively, the external bread component can be a single component that is folded over the one or more internal components to form the sandwich type foodstuff. The bread component includes dough based or bread based leavened or unleavened products, including but not limited to bread, bun, muffin, English muffin, biscuit, pancake, and tortilla. Examples of sandwich type foodstuffs include breakfast sandwiches, hamburgers, paninis, grilled sandwiches, toasted sandwiches, soft shell tacos, burritos, and the like.

Typically, the internal components of a sandwich type foodstuff include a protein component, a vegetable component, a cheese component, one or more condiments, and combinations thereof. Examples of suitable protein components include, but are not limited, to meats, such as turkey, chicken, ham, or beef, hamburger patty, hot dogs, sausage patty or links, eggs, omelet, and non-meat proteins such as soy-based meat substitutes, textured vegetable protein, tofu, tempeh, seitan, quorn, and the like.

Figure 2:
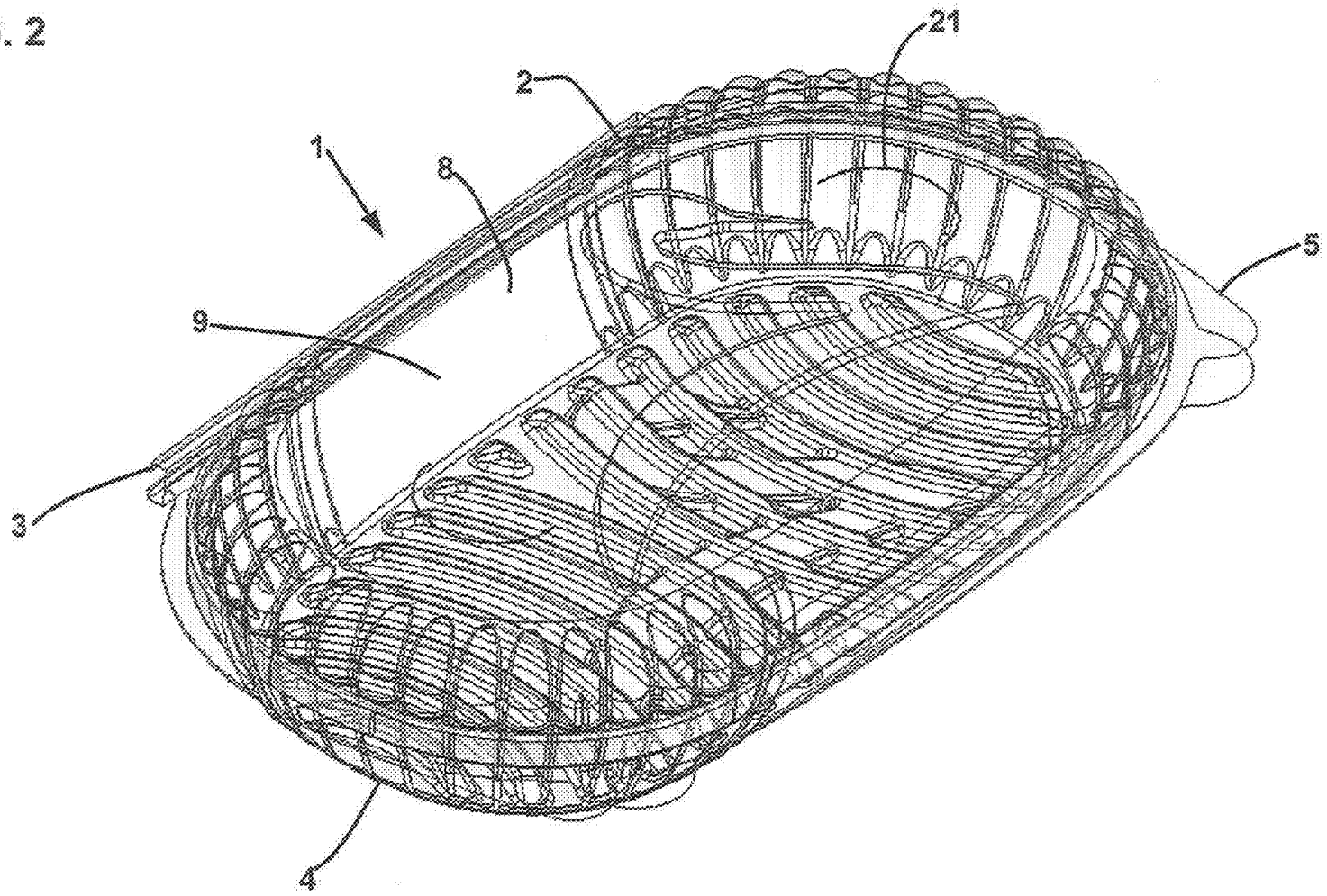
FIG. 2 depicts a perspective view of the container of FIG. 1 in a closed position.
Figure 3:
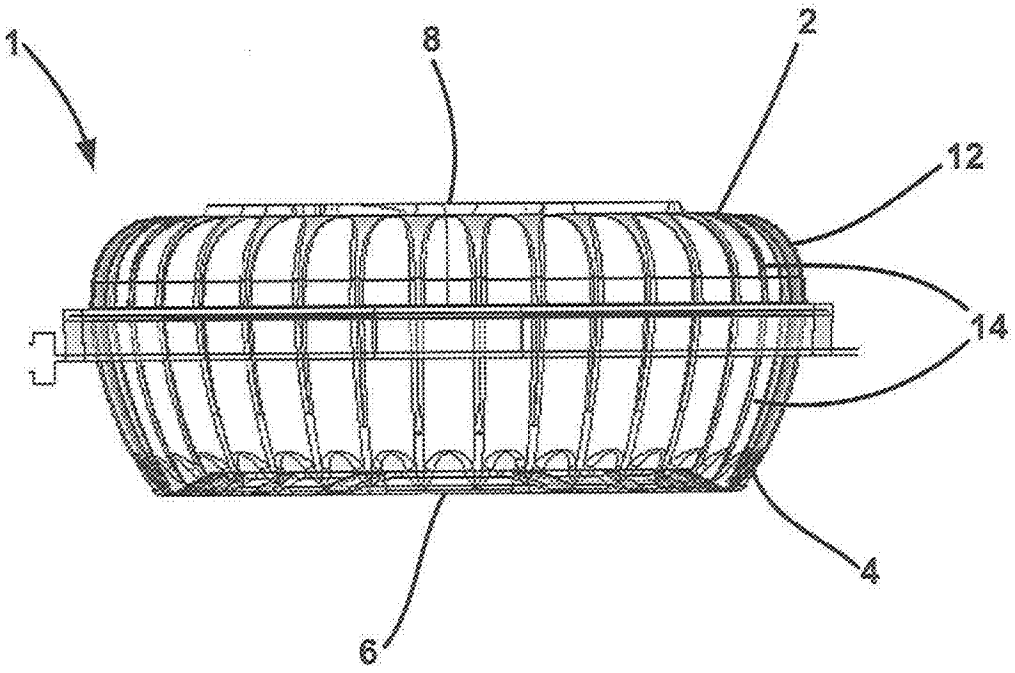
FIG. 3 depicts an end view of the container of FIG. 1 in a closed position.
Figure 4:
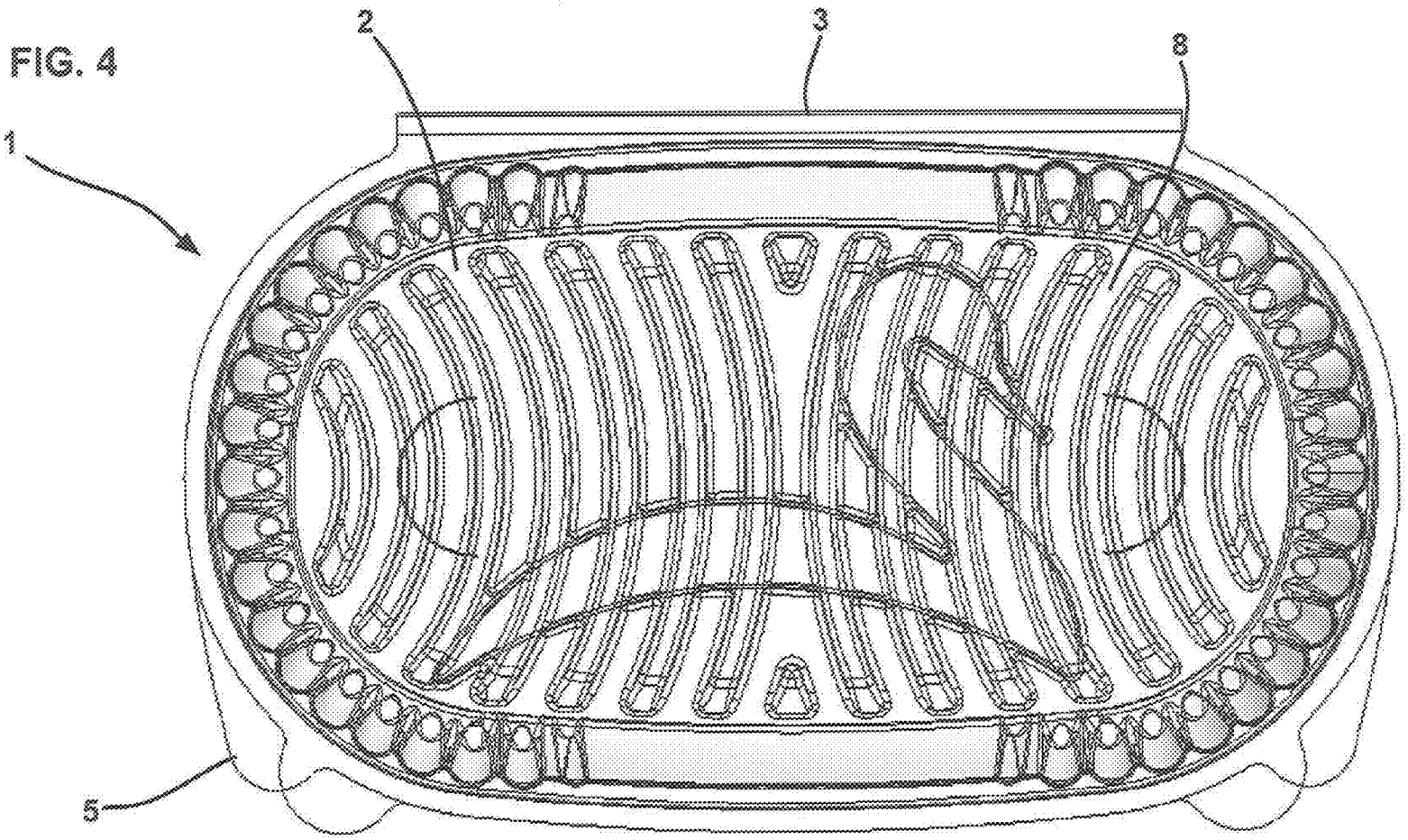
FIG. 4 depicts a top view of the container of FIG. 1 in a closed position.
Figure 5:
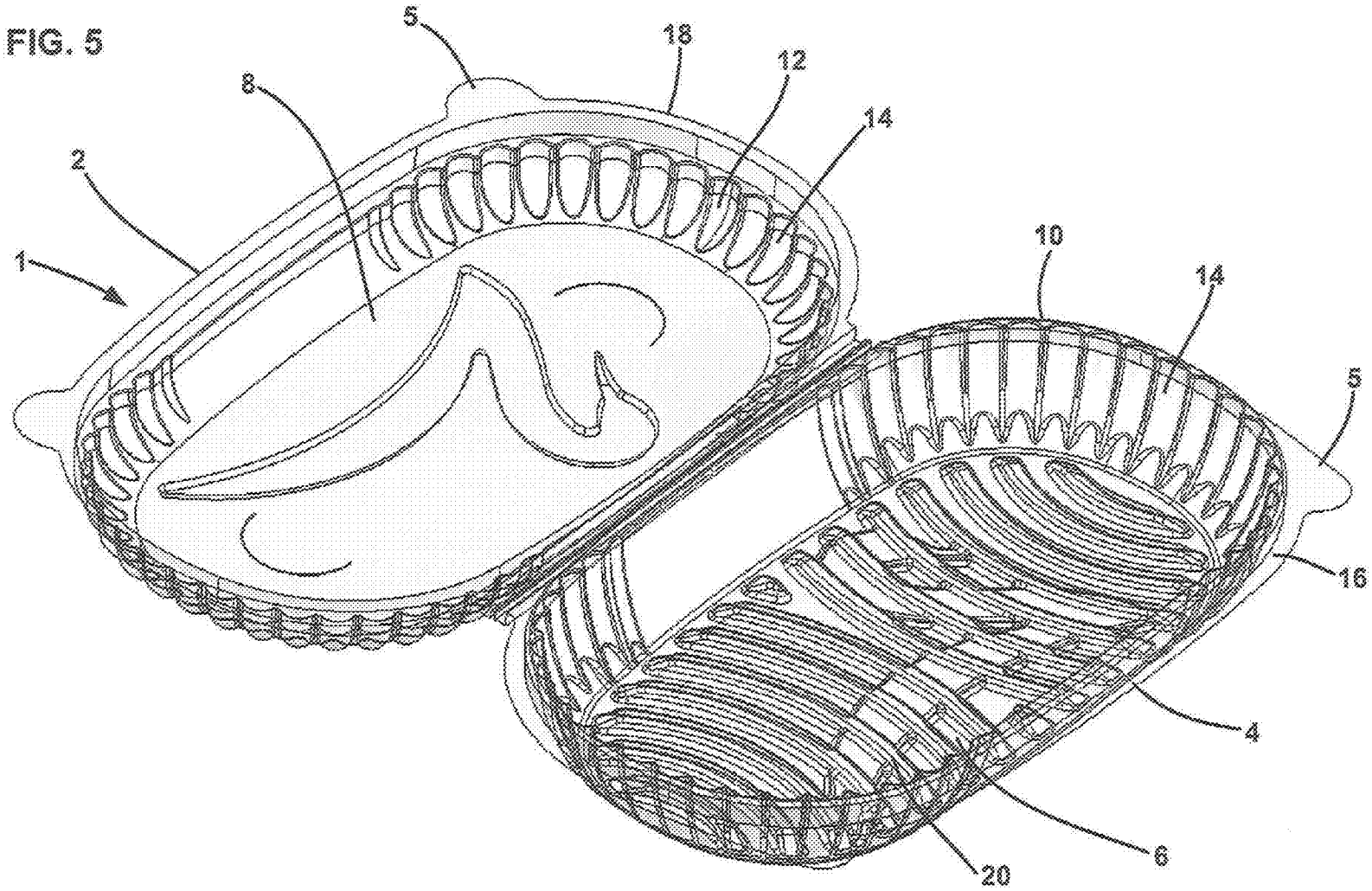
FIG. 5 depicts a perspective view of the container of FIG. 1 in an open position.
Figure 6:
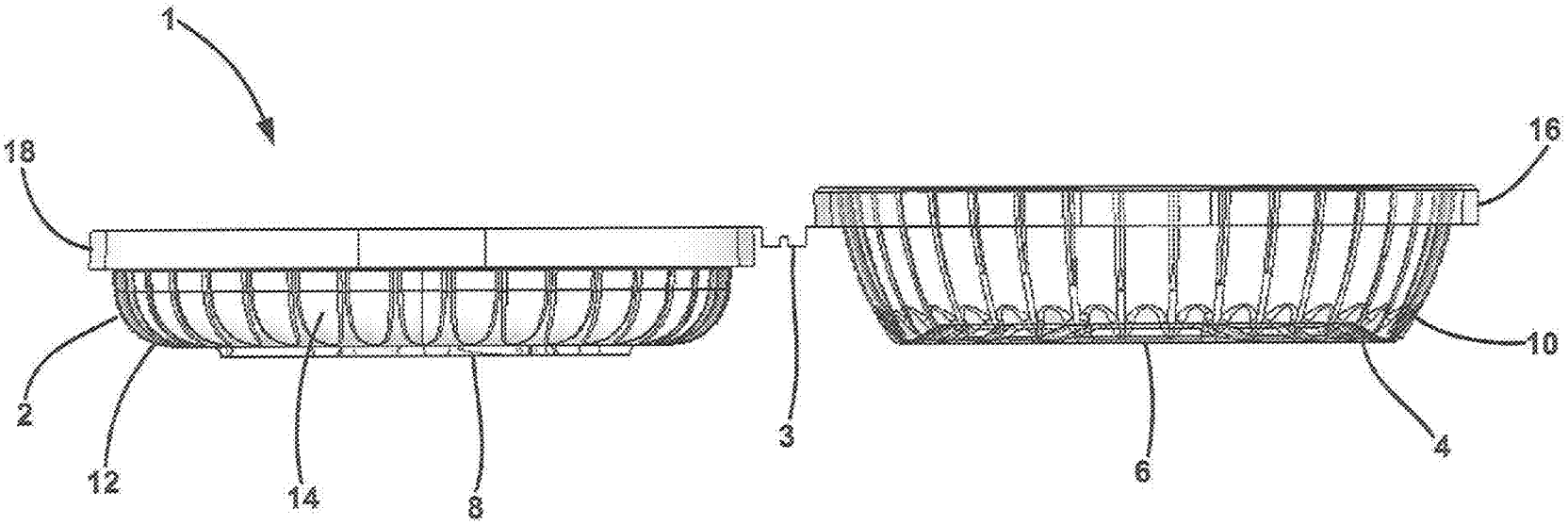
FIG. 6 depicts an end view of the container of FIG. 1 in an open configuration.

The figures depict an embodiment of the microwaveable container of the disclosure for transporting, freezing, storing, and single-step cooking of a multi-component foodstuff. FIGS. 1, 5 and 6 depict the container in an open position. FIGS. 2-4 depict the container in a closed position. In general, the container is a unitary tray having a base portion and a lid portion. The container may be manufactured using conventional techniques, including injection molding, injection blow molding, compression molding, injection stretch molding, composite injection molding, and roto-molding, from a microwavable plastic material suitable for contact with food. The plastic material can be a thermoplastic material. Examples of thermoplastic materials include polyesters, polystyrenes, polypropylenes, polyethylenes, and mixtures thereof. The plastic material from which the container is formed is generally about a 10 mil to about a 25 mil plastic. In an embodiment, the plastic material from which the container is formed is about a 10 mil to about a 15 mil plastic. In an embodiment, the container is formed from plastic sheet which has been pre-cut or in the form of a continuous web or roll formed. Preferably, the lid portion of the container is formed from a see-through or transparent plastic material allowing for viewing of the multicomponent foodstuff within the container through the lid portion.

Referring to FIG. 1, a hinge portion (3) is integrally formed with both the base portion (4) and the lid portion (2) of the container (1). At least one of the base portion (4) and lid portion (2) may also include one or more tabs (5) that may be used to help separate the base portion (4) from the lid portion (2) when the container (1) is in the closed position. As shown in FIG. 2, FIG. 3, and FIG. 4, when in the closed position, the base portion (4) and the lid portion (2) define an interior chamber (9).

Referring to FIG. 5, each of the base portion (4) and the lid portion (2) of the container (1) include a substantially flat central section. For the base portion (4), this flat section may be referred to as a bottom (6). For the lid portion (2), the flat section may be referred to as a top (8). Extending from each of these flat sections are contiguous walls that entirely surround the flat sections. In the depicted embodiment, each of the base wall (10) and the lid wall (12) are curved and include a plurality of fluted, scalloped, or otherwise textured grooves (14). These grooves (14) improve the aesthetics of the container and provide support to the contiguous walls. Referring now to FIG. 6, each contiguous wall terminates at a projection, which in the depicted embodiment is also contiguous with the entire wall. In alternative embodiments, one or more discrete projections may be formed at an edge of each wall. These projections, referred to herein as a base wall projection (16) and a lid wall projection (18), are adapted to mate when the container is in the closed position. When in mating engagement, the projections hold the base portion and the lid portion together as shown in FIG. 2, FIG. 3, and FIG. 4.

Referring now to FIG. 1, the bottom (6) of the base portion (4) defines a plurality of channels (20) that may be curved as depicted, straight, or may form some other shape or pattern. The function of these channels is described in further detail below. The top (8) of the lid portion (2) defines one or more vents (21), which in the depicted embodiment are curved slits. In other embodiments, the vents may be one or more holes or perforations defined by the top. Slits may be advantageous, though, as openings may admit dust, dirt, or other contaminants into the interior chamber and foul the foodstuff located therein. During heating of the container and the foodstuff, the vents are opened due to increased heat within the interior chamber. In that regard, the vents help vent excess pressure and steam, while the container remains in the closed position due to the mating projections, which helps control the cooking process.

Figure 7:
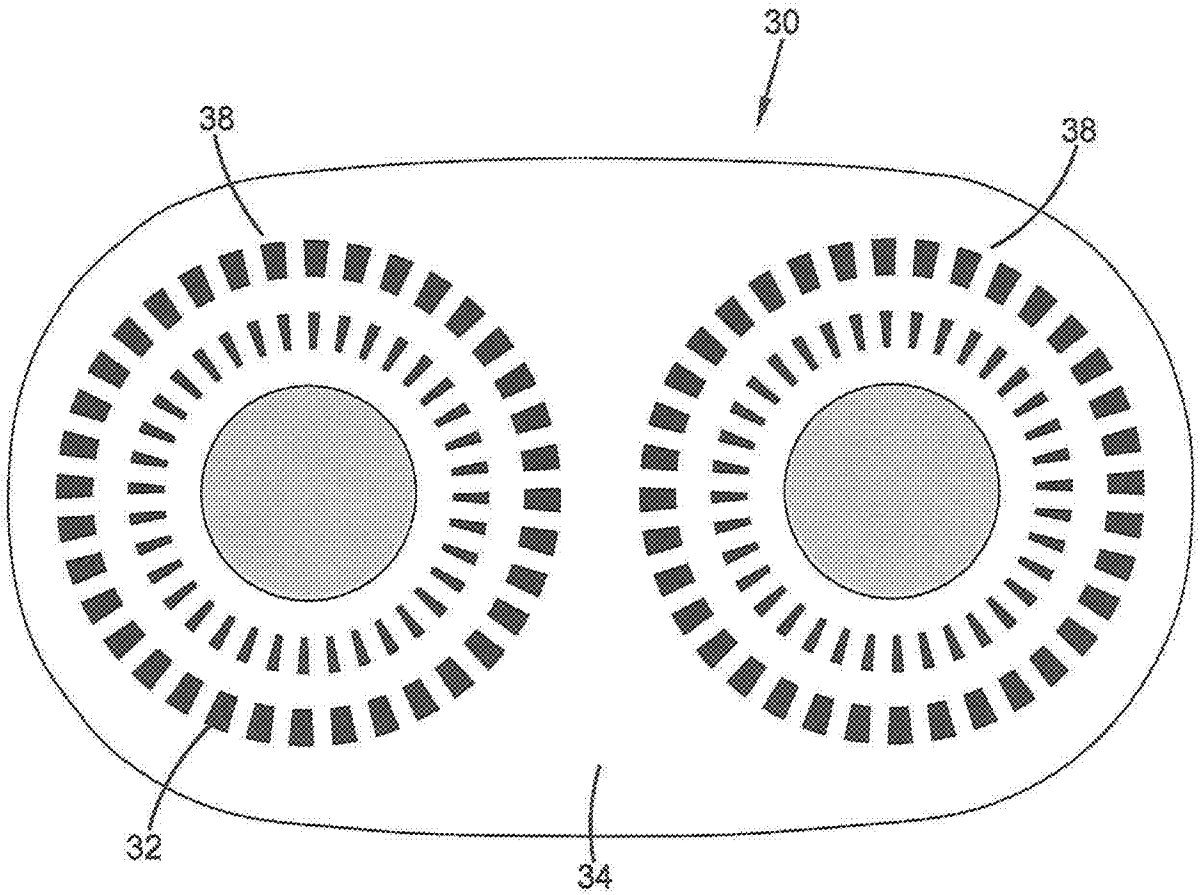
FIG. 7 depicts an inside top view of a susceptor to be utilized with the container of FIGS. 1-6.

FIG. 7 depicts a susceptor (30) to be used in conjunction with the container described herein. The susceptor is a generally a thin substrate sheet including layers of metal or ceramic, plastic, and/or other materials, such as adhesives. In a typical embodiment as shown in FIG. 7, a metalized plastic film (32) is laminated to a dimensionally stable substrate (34), such as paper, cardboard, or paperboard base, by utilizing a conventional adhesive. The metalized plastic film generally includes a layer of plastic film which is deposited on a layer of metal or ceramic. The susceptor generally contains one or more food component receiving regions 38. These regions may be patterned regions to control browning and crisping. Patterns may be embedded into the metalized film to control and/or increase its effectiveness. The susceptor can also utilize dielectric foam silicate substrates; semi-liquid glossy materials that include glycerine, sucrose ester, and chloride salt; multiple plastic layers; and edible adhesives.

Figure 8:
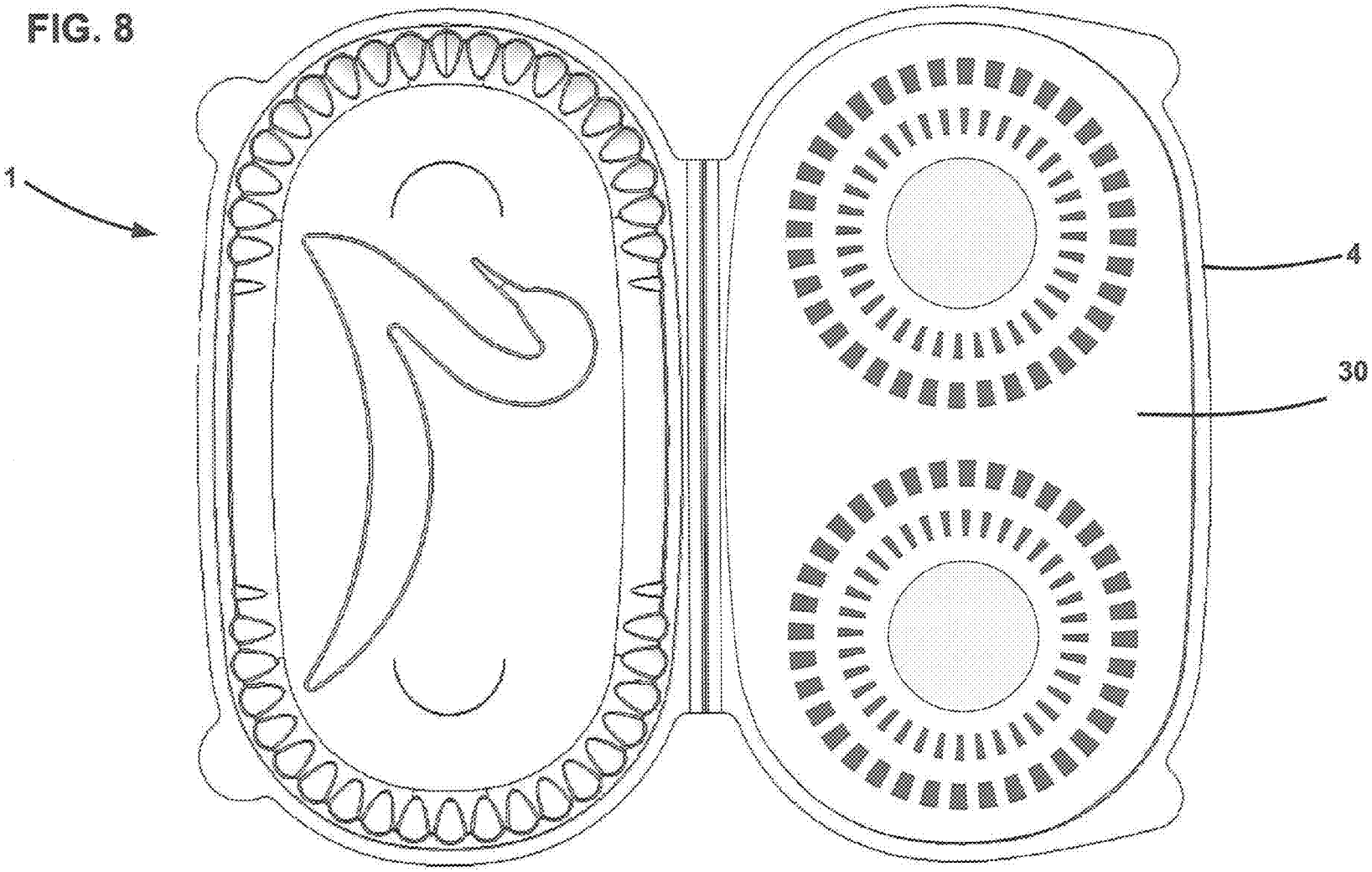
FIG. 8 depicts a container according to FIG. 1 configured with a susceptor.

Referring to FIG. 8, the susceptor (30) is inserted into the base portion (4) of the container (1) and is positioned adjacent to the bottom of the base portion (4). When heated in a microwave, the susceptor becomes a non-stick heating surface, much like a hot plate. The metalized plastic film controls the microwave conductivity and converts some of the microwave's energy into heat, which is transmitted to the surface portion of the susceptor that the multi-component foodstuff is positioned upon, causing browning and/or crisping of the multi-component foodstuff.

Figure 9A:
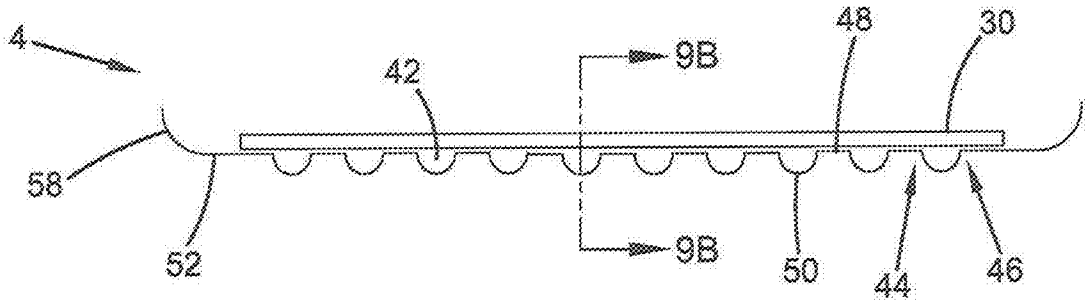
FIGS. 9A and 9B are enlarged partial cross-sectional views of a base portion of the microwaveable container of FIGS. 1-6 and the susceptor of FIG. 7.
Figure 9B:
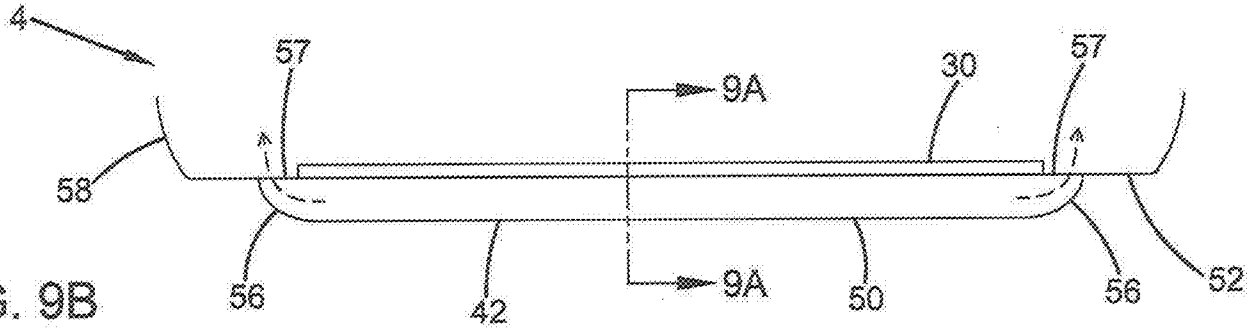

FIGS. 9A and 9B depict cross-sectional views of a base portion (4) of a container of the disclosure in conjunction with a susceptor (30). As depicted, each channel (42) includes outer edges that define the limits of the channel, for example, a first outer edge (44) and a second outer edge (46). The outer edges of adjacent channels are connected by a connecting surface (48) that forms the bottom (52) of the base portion (4). The outer edges of a single channel are connected by a recessed central portion (50) that is lowered relative to the connecting surface (48). The recessed central portion (50) is typically lowered about ⅛ inch to about ¼ inch relative to the connecting surface to define the channel (42). The recessed central portion may be substantially U-shaped, V-shaped, or flat-bottomed, as required or desired for a particular application. During microwave cooking, excessive moisture in the container may condense or pool in the channels in the base portion of the container which effectively isolate moisture sensitive components, such as external bread components, of the multi-component foodstuff from the pooled moisture.

When received in the base portion (4), the susceptor (30) rests on the raised connecting surfaces. With the susceptor inserted, the channels (42) (as bounded at an upper extent by the susceptor) are substantially closed conduits, except at the channel ends (56), which may form a part of the base wall (58). A gap (57) between the outer edge of the susceptor (30) and the channel end (56) allows steam to escape from beneath the susceptor. The susceptor can also optionally include one or more vents or perforations to allow a controlled portion of steam to directly contact components of the multi-component foodstuff positioned adjacent to the top side of the susceptor, such as external bread components. In these ways, contact between the escaping steam and the multi-component foodstuff placed on the susceptor can be controlled. This is especially advantageous when the multi-component foodstuff includes a bread component or another moisture-sensitive component. In embodiments, the steam escapes and travels upward within the interior chamber of the closed container, where it heats both the bread component and the moisture-insensitive component located on top of the bread component.

The steam provides a consistent cooking temperature within the closed container, such that the multi-component foodstuff cooked within the container is evenly and thoroughly cooked. Preferably, the cooking temperature in the container is about 160° F. to about 190° F. In an embodiment, the cooking temperature in the container is about 170° F. to about 190° F. The steaming of the bread component in combination with the heating provided by the susceptor provides a cooked bread component having a desirable browned and crisped exterior surface and a soft and chewy interior. Preferably, the multi-component food stuff reaches a temperature of about 160° F. to about 190° F. during the cooking process. In an embodiment, the multi-component food stuff reaches a temperature of about 170° F. to about 190° F. Dependent upon the moisture content of the multi-component foodstuff, an amount of moisture can be added to the container to provide a sufficient amount of steam during the microwave cooking process to attain the desired cooking temperature. For example, when cooking a low moisture foodstuff, an amount of moisture can be provided in one or more channels in the base portion of the container to provide a sufficient amount of steam during the microwave cooking process.

Figure 10:
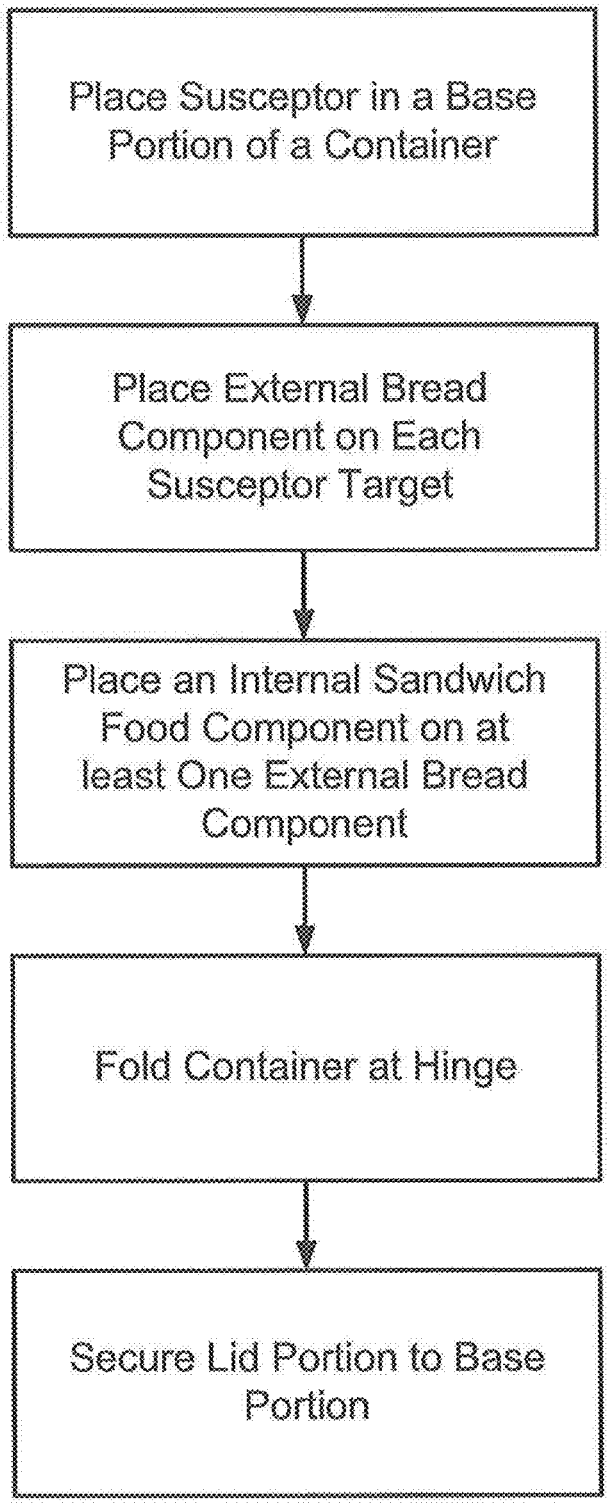
FIG. 10 depicts a method of packaging a multi-component foodstuff.

FIG. 10 depicts a method of packaging a multi-component foodstuff, such as a partially-assembled sandwich type foodstuff, in a container such as the type described herein. The method includes placing a susceptor in a base portion of a folding food container. The susceptor generally includes two food component-receiving regions to control the browning and crisping of an external bread component, which is positioned adjacent to each of the receiving regions. In embodiments, the receiving region is a patterned region. Each of the bread components constitutes one half of the sandwich type foodstuff such that the sandwich type foodstuff is positioned in an open face, side-by-side orientation on the top side of the susceptor. Alternatively, the bread component is a continuous single component positioned adjacent to the top side of the susceptor and covering the patterned regions of the susceptor that, when folded over upon completion of microwave cooking, forms the sandwich type foodstuff.

One or more internal sandwich filling components is placed on each of the external bread components. The internal components can be moisture-sensitive or moisture insensitive components. Each half of the sandwich type foodstuff typically includes a protein component, a vegetable component, one or more condiments, a cheese component, or a combination thereof. In an embodiment, each half of the sandwich type foodstuff includes a protein component. The internal components of the sandwich type foodstuff are typically distributed substantially equal on a weight basis between each half of the foodstuff to balance the heating load such that each side of the sandwich type foodstuff cooks evenly and thoroughly at substantially the same rate. In an embodiment, a cheese component, such as a slice of cheese, is positioned on top of the top surface of each of the external bread components. During the microwave cooking process, the cheese component melts and seals the top surface of the bread component preventing the bread component from becoming soggy or soft from moisture or juices emanating from protein and/or vegetable components during the microwave cooking process that are positioned on top of the bread component.

Once each side of the sandwich type foodstuff is assembled, the container is then folded along a hinge portion and the base portion is secured to a lid portion so as to secure the container in the closed position. If desired the closed container can be inserted into further packaging, such as a box or wrapped in a plastic film, as may be required or desired for marketing, transport, or storage purposes of the product.

Figure 11:
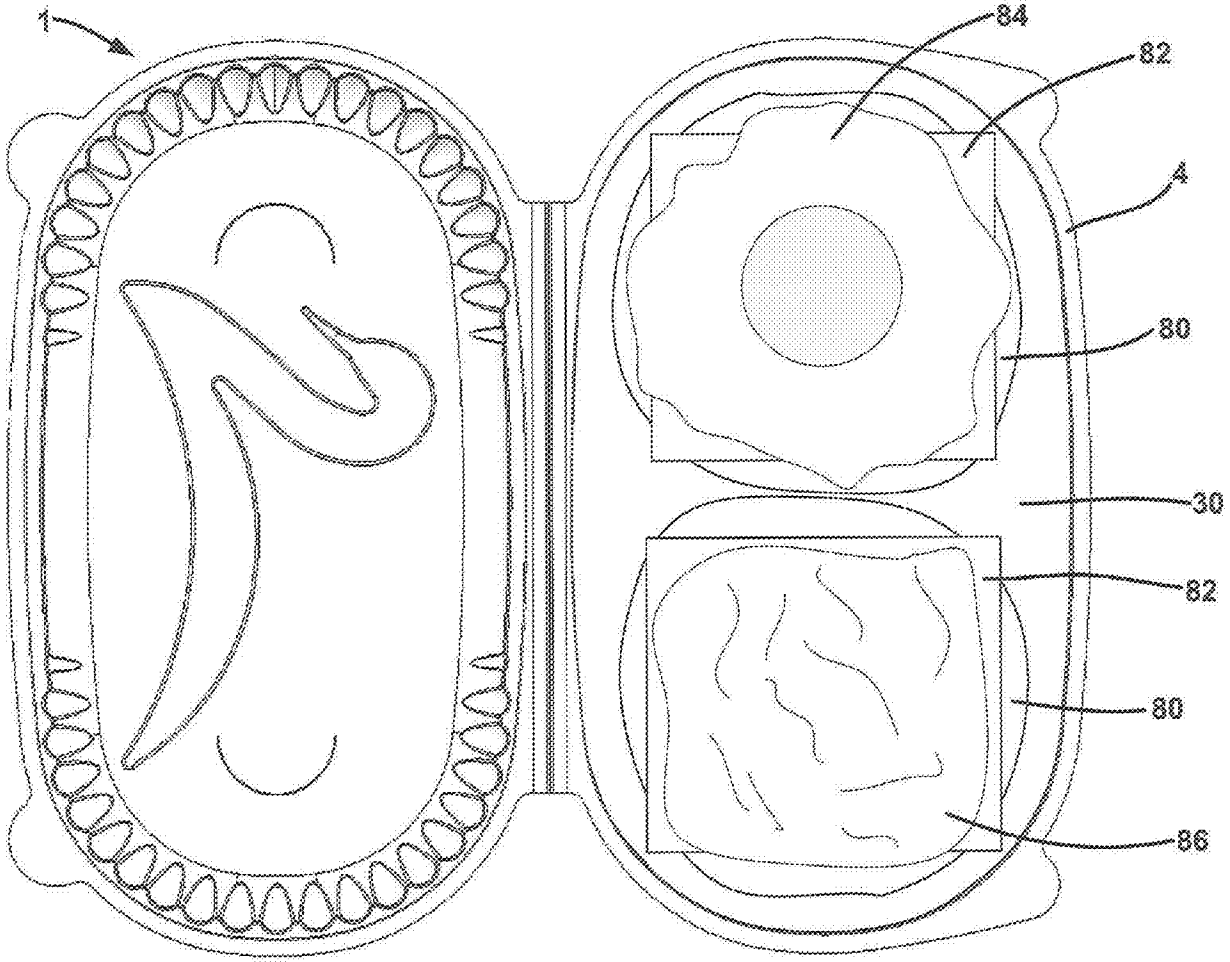
FIG. 11 depicts an inside top view of the container of FIG. 8 containing a multi-component foodstuff

One example of a multi-component food assembly in a container of the disclosure is shown in FIG. 11. The susceptor (30) is positioned in the base portion (4) of the container (1). An external component (80), such as a bread component, is positioned over each of food component-receiving region of the susceptor (30). A cheese component (82) is optionally positioned on top of the external component (80), followed by one or more protein components, such as an egg (84) or a meat (86).

The multicomponent foodstuff in the container can be heated in a single microwave step. The closed container containing the multicomponent foodstuff is placed in a microwave and heated so as to cook the internal foodstuff in a one-step process. Generally the closed container is heated for about 45 seconds to about 4 minutes in the microwave. The cooking time, however, can vary dependent on the wattage of the microwave oven and foodstuff being cooked in the container. In an embodiment, the closed container is heated for about 1 minute to about 2.5 minutes in an 1100 W microwave oven. The container is then removed from the microwave oven, opened, and each half of the multi-component foodstuff is combined or folded over onto the opposing half to form the finished, hot foodstuff, such as a sandwich type foodstuff.

What is claimed is:

1. A method of packaging a multi-component foodstuff in a microwavable container, wherein the multi-component foodstuff comprises an external food component and one or more internal food components, the external food component having a first portion and a second portion, the first portion being separate from the second portion, wherein the internal food component can be placed between the first portion and the second portion, the method comprising:

placing the external food component in the microwavable container, wherein the microwavable container comprises:

a base portion with a bottom defining a plurality of channels having a first end and a second end, a lid portion, and a susceptor positioned on the base portion, the susceptor defining two food component-receiving regions and having an outer circumference, wherein when the susceptor is positioned on the bottom of the base portion, the first and second ends of at least some of the plurality of channels extend beyond the circumference of the susceptor, and wherein the first portion of the external food component is placed on one of the two food component-receiving regions and the second portion of the external food component is placed on another of the two food component-receiving regions, the first and second portions of the external food component having a top surface and a bottom surface wherein the bottom surface is positioned adjacent to the base portion of the susceptor;

placing one or more internal food components on the top surface of each of the first and second portions of the external food component to form the multi-component foodstuff;

placing the lid portion on top of the base portion; and securing the base portion to the lid portion, wherein, after securing, the container is in a closed position where the two food component-receiving regions are positioned side by side on the base portion.

2. The method of claim 1, wherein the external food component comprises a bread component.

3. The method of claim 2, wherein the bread component comprises bread, bun, pancake, muffin, biscuit, or tortilla.

4. The method of claim 1, wherein the one or more interior food components comprise a protein component, vegetable component, cheese component, one or more condiments, or a combination thereof.

5. The method of claim 1, wherein the protein component comprises a meat, egg, omelet, or meat substitute.

6. The method of claim 5, wherein the meat comprises turkey, chicken, ham, beef, hamburger patty, hot dog, sausage patty, or sausage link.

7. The method of claim 5, wherein the meat substitute comprises a soy-based meat substitute, textured vegetable protein, tofu, tempeh, seitan, or quorn.

8. The method of claim 1, wherein the microwavable container comprises a hinge portion integrally formed with the base portion and the lid portion.

9. The method of claim 8, wherein placing the lid portion on top of the base portion comprises folding the container along the hinge portion.

10. The method of claim 1, wherein the base portion of the microwavable container comprises:

a contiguous base wall surrounding the bottom, wherein the contiguous base wall comprises a base wall projection, and the lid portion comprises:

a top defining at least one vent; and a contiguous lid wall surrounding the top, wherein the contiguous lid wall comprises a lid wall projection adapted to mate with the base wall projection when the container is in a closed position.

11. The method of claim 10, wherein the susceptor is removable, and wherein when received in the container, the susceptor rests on the bottom.

12. The method of claim 11 further comprising as a first step placing the susceptor on the base portion.

13. The method of claim 10, wherein the channels comprise a first edge and a second edge, and wherein the first edge and the second edge are raised relative to a recessed central portion of the channel.

14. The method of claim 13, wherein a first edge of a first channel is connected to a first edge of a second, adjacent channel with a connecting surface.

15. The method of claim 14, wherein the susceptor rests on the connecting surface when received in the container.

16. The method of claim 10, wherein the base wall projection is contiguous along the base wall.

17. The method of claim 16, wherein the lid wall projection is contiguous along the lid wall.

18. The method of claim 10, wherein when the container is in the closed position, the base portion and the lid portion define an interior chamber.

19. The method of claim 8, wherein the at least one vent is adapted to open due to an increase in pressure within the interior chamber.

20. The method of claim 10, wherein at least one of the base portion and the lid portion comprises a tab extending therefrom.

21. The method of claim 1, wherein the multi-component foodstuff comprises a breakfast sandwich wherein the first and second external component comprise a biscuit or muffin, and the internal component comprises a cheese component and a protein component.

22. The method of claim 21, wherein the protein component comprises turkey, chicken, ham, beef, sausage patty, sausage link, egg, or omelet, and at least one of the first and second external components comprises an egg or omelet positioned on the top surface of the external component.

23. The method of claim 1 comprising placing a first internal food component on the top surface of the first portion of the external food component and placing a second internal food component on the top surface of the second portion of the external food component to form the multi-component foodstuff, wherein the first internal food component is separate from the second internal food component.

24. A method of packaging a multi-component foodstuff in a microwavable container, wherein the multi-component foodstuff comprises an external food component and one or more internal food components, the external food component consisting of a first portion and a second portion and having an outer surface and an inner surface, wherein the internal food component can be placed between the first portion and the second portion with the inner surface facing the internal food component, and the microwavable container comprises a base portion with a bottom defining a plurality of channels having a first end and a second end, a lid portion, and a susceptor positioned on the base portion, the susceptor defining a first food component-receiving region and a second food component-receiving region and having an outer circumference, wherein when the susceptor is positioned on the bottom of the base portion, the first and second ends of at least some of the plurality of channels extend beyond the circumference of the susceptor, the method comprising:

placing the external food component in the microwavable container so that the outer surface faces the susceptor, wherein the first portion of the external food component is placed on the first food component-receiving regions and the second portion of the external food component is placed on the second food component-receiving regions;

placing one or more internal food components on the inner surface of the first and second portions of the external food component to form the multi-component foodstuff;

placing the lid portion on top of the base portion; and securing the base portion to the lid portion, wherein, after securing, the container is in a closed position where the two food component-receiving regions are positioned side by side on the base portion.

25. The method of claim 1, wherein the bottom has an outer circumference connecting the bottom to a base wall, and wherein the first and second ends of the plurality of channels do not contact the outer circumference.

26. The method of claim 1, wherein when the susceptor is positioned on the bottom of the base portion, the channels are substantially closed conduits with open ends.

27. The method of claim 1, wherein the susceptor comprises vents constructed to control contact of steam with the external food component when the container is used to cook the multi-component foodstuff.

* * * * *